US006685047B1

(12) United States Patent
Mott et al.

(10) Patent No.: US 6,685,047 B1
(45) Date of Patent: Feb. 3, 2004

(54) GLASS BEVERAGE CONTAINER WITH THERMALLY INSULATED EXTERIOR SURFACE

(75) Inventors: Geoffrey P. Mott, P.O. Box 6044, Blue Jay, CA (US) 92317; Maryann S. Mott, P.O. Box 6044, Blue Jay, CA (US) 92317; Richard Freeman, Boynton Beach, FL (US)

(73) Assignees: Geoffrey P. Mott; Maryann S. Mott

( * ) Notice: Subject to any disclaimer, the term of this patent is extended or adjusted under 35 U.S.C. 154(b) by 0 days.

(21) Appl. No.: 10/174,785

(22) Filed: Jun. 18, 2002

(51) Int. Cl.[7] ..... B65D 1/10; B65D 23/10
(52) U.S. Cl. ..... 220/753; 215/396; 215/398
(58) Field of Search ..... 220/759, 753; 215/398, 396

(56) References Cited

U.S. PATENT DOCUMENTS

| | | | | | |
|---|---|---|---|---|---|
| 5,738 | A | | 8/1848 | Ballinger | |
| 72,195 | A | * | 12/1867 | Hailes | 220/774 |
| 908,285 | A | * | 12/1908 | Lewis | 220/763 |
| 1,235,309 | A | * | 7/1917 | Garretson | 38/95 |
| 1,965,354 | A | * | 7/1934 | Patock | 16/421 |
| 2,600,902 | A | * | 6/1952 | Messerschmidt | 220/753 |
| 4,366,596 | A | * | 1/1983 | Hellinger et al. | 220/753 |
| 4,984,707 | A | | 1/1991 | Fierthaler | |
| 5,154,306 | A | | 10/1992 | Wyatt | |
| 5,217,141 | A | | 6/1993 | Ross | |
| 5,497,902 | A | | 3/1996 | Crock | |
| 5,988,419 | A | * | 11/1999 | St John | 215/398 |
| 6,076,699 | A | | 6/2000 | Seager et al. | |

* cited by examiner

*Primary Examiner*—Joseph M. Moy
(74) *Attorney, Agent, or Firm*—Knobbe Martens Olson & Bear LLP

(57) ABSTRACT

A glass beverage container having a thermally insulated exterior surface that reduces the heat transfer between the glass beverage container and the hand of the person holding the glass. A thermally insulating material is fixedly attached to the glass handle or glass side wall of a beverage container. The thermally insulating material is bonded to the glass via an adhesive. The insulating material can comprise one or more layers of material such as rubberized latex and/or Neoprene. The glass beverage containers can include, but are not limited to, beer mugs, soda glasses, or pitchers.

12 Claims, 2 Drawing Sheets

GLASS BEVERAGE CONTAINER WITH THERMALLY INSULATED EXTERIOR SURFACE

BACKGROUND OF THE INVENTION

1. Field of the Invention

This invention relates to beverage containers, in particular, to glass beverage containers with a thermally insulated exterior surface.

2. Description of the Related Art

Most restaurants and drinking establishments such as pubs and taverns serve beer and other cold drinks in beverage containers made out of glass. These beverage containers include glass pitchers, beer and soft drink glasses of all sizes and shapes. Some of the more common glass beverage containers include pint glasses, pilsner glasses, goblets, and glass mugs. When cold drinks such as beer or soda are poured into the glass containers, the temperature of the glass can drop to a point where it becomes uncomfortable for a person to hold the glass by hand. The person's discomfort is further exacerbated in some establishments where, as a common practice, the glass is chilled in the freezer before pouring beer or other beverage into the glass. Similarly, when hot drinks such as hot chocolate or coffee are poured into a glass container, the heat can quickly transfer to the glass and make the glass uncomfortable to hold by hand.

While thermally insulating holders have been designed for drinking vessels such as aluminum beverage cans, it is impractical to fit beer mugs or tall pilsner glasses into such holders. Although there are plastic coffee mugs equipped with plastic insulating handles, the inventor is not aware of any drinking vessels made out of glass that have insulating material attached to the exterior surface of the glass to provide thermal insulation. This may be due in part to the difficulty of attaching a suitable insulating material to a glass surface in a manner such that the insulating material can withstand repeated high temperature washing cycles as well as the freezing temperatures inside freezers without becoming detached from the glass surface.

Hence, there is a need for a glass,beverage container with a thermally insulated exterior surface so as to reduce the discomfort of the person holding the container when the glass is cold or hot. To this end, there is a particular need for a glass beverage container having a thermally insulating material attached to its outer surface in a manner such that the insulating material remains bonded to the glass surface even after repeated exposures to extreme temperature conditions.

SUMMARY OF THE INVENTION

In one aspect, the preferred embodiments of the present invention provide a glass beverage container having a thermally insulated handle. The glass beverage container can include, but is not limited to, beer mugs, soda glasses, and pitchers. In one embodiment, the glass beverage container comprises a base member and a glass side wall extending from the outer perimeter of the base member in a manner such that a cavity is formed by the side wall and the base member. The beverage container further comprises a glass handle that is attached to the exterior surface of the glass side wall in a manner so as to permit a person to hold the handle by hand and lift the beverage container. Furthermore, a thermally insulating material is positioned adjacent the exterior surface of the glass handle to reduce the amount of heat transfer between the glass handle and the hand of the person holding the handle.

The thermally insulating material is fixedly attached to the handle and can comprise a variety of insulating materials such as rubberized latex and Neoprene. Preferably, the thermally insulating material has a thermal conductivity lower than that of glass. Moreover, the thermally insulating material preferably has a non-skid surface and is bonded to the glass handle by way of an adhesive. The adhesive preferably contains the compound cyanoacrylate and, in one embodiment, comprises a gel form of super glue sold under the name of QUICKTITE®. The thermally insulating material can comprise a single layer of insulating material or multiple layers of the same or different material, depending on the particular application. In one preferred embodiment, the thermally insulating material comprises at least two layers of different material wherein the first layer comprises a rubberized latex and the second layer comprises Neoprene. Preferably, the rubberized latex is directly bonded to the glass handle while the Neoprelne is bonded to an outer surface of the rubberized latex.

In another aspect, the preferred embodiments of the present invention provide a glass drinking vessel having a thermally insulating material fixedly attached to at least a portion of the exterior surface of the side wall of the drinking vessel. Preferably, the thermally insulating material is positioned adjacent an area of the exterior surface of the side wall where it is convenient for a person to grasp and hold the glass. The thermally insulating material can comprise a single layer of insulating material or multiple layers of the same or different material. In one embodiment, the thermally insulating material comprises a layer of Neoprene or rubberized latex that is fixedly bonded to the outer surface of the glass side wall. The insulating material is preferably bonded to the glass surface via an adhesive that contains cyanoacrylate. In another embodiment, the thermally insulating material comprises at least two layers of different material wherein the first layer comprises a rubberized latex and the second layer comprises Neoprene. Preferably, the rubberized latex is directly bonded to the glass side wall while the Neoprene is bonded to an outer surface of the rubberized latex.

In yet another aspect, the preferred embodiments of the present invention provide a drinking container comprising a base section and a sidewall section that is attached to the base section so as to define an interior volume that receive the drinking liquid. Preferably, the drinking container defines a surface at which the user grasps the drinking container and wherein an insulative material is bonded to the surface so as to withstand repeated temperature changes as a result of use and washing of the drinking container and wherein the insulative material reduces heat transfer between the user's hand and the drinking liquid contained within the interior volume of the drinking liquid. In one embodiment, the insulative material comprises Neoprene. In another embodiment, the insulative material comprises a rubber material.

Advantageously, the glass beverage containers having a thermally insulating material attached to the exterior surface of the glass side wall or handle protect the person holding the container from the coldness or heat of the glass. As such, the glass beverage containers can be chilled or can contain extremely cold or hot drinks without causing discomfort to the person holding the container. Unlike glass surfaces which can be made slippery by condensation, the non-skid surface of the insulating material allows the person to obtain a solid hold of the beverage container even if the container is filled with a cold liquid. Furthermore, the thermally insulating material is securely bonded to the glass in a manner such that material can withstand repeated exposures to extreme cold or hot temperatures without becoming detached from the glass surface.

DETAILED DESCRIPTION OF THE PREFERRED EMBODIMENT

Figure 1:
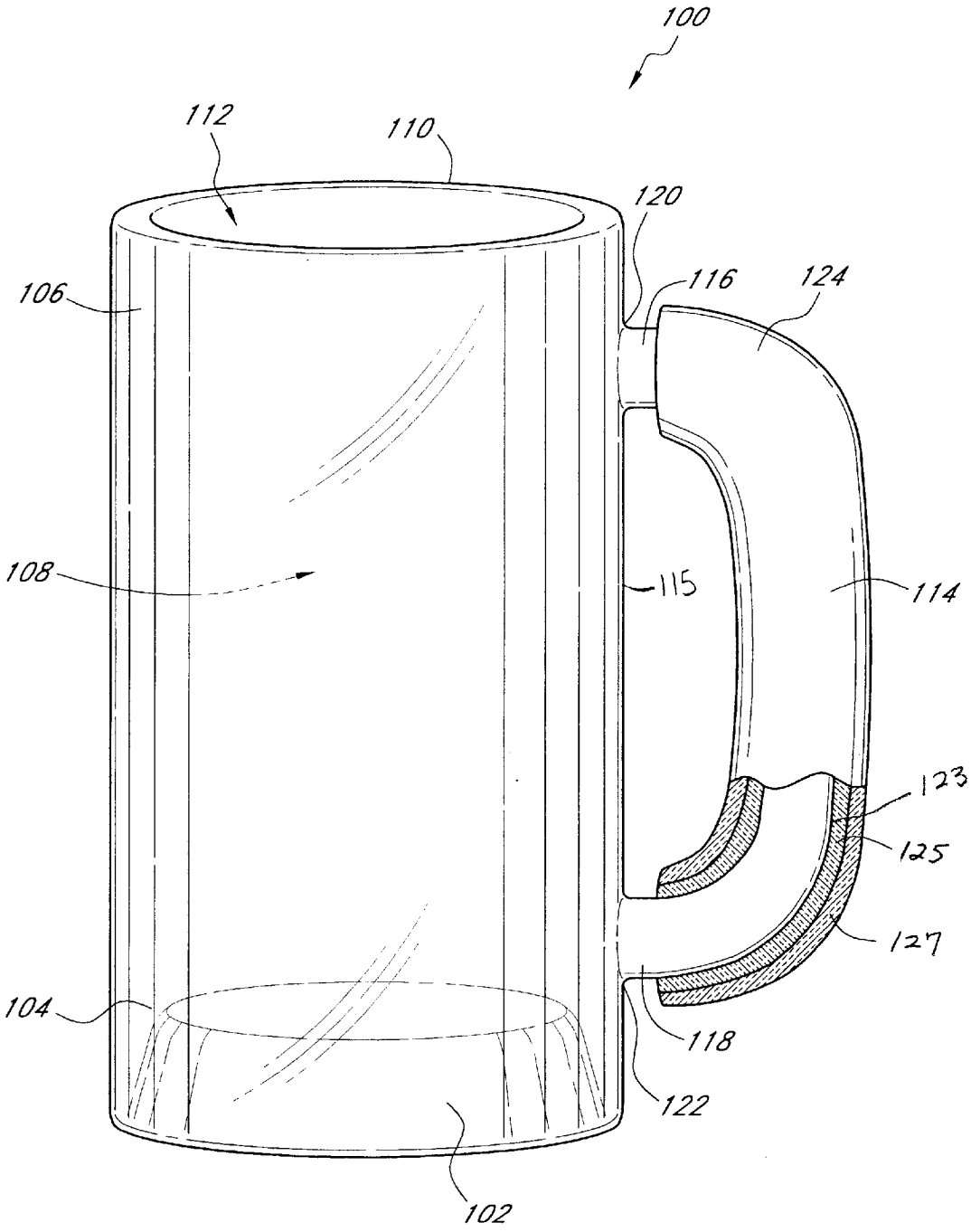
FIG. 1 illustrates a glass beverage container of one preferred embodiment.

References will now be made to the drawings wherein like numerals refer to like parts throughout. FIG. 1 shows a glass beverage container 100 of one preferred ms embodiment of the present invention. As shown in FIG. 1, the glass beverage container 100 generally comprises a base member 102 and a glass side wall 106 that extends from an outer perimeter 104 of the base member 102 in a manner such that a cavity 108 is formed by the base member 102 and the side wall 106. Preferably, the cavity 108 is configured to hold liquids such as beer, juice, water, or various soft drinks. The size and shape of the cavity 108 can vary without departing from the scope of the invention. Furthermore, an upper edge 110 of the side wall 106 defines an opening 112 that is sufficiently large for liquid to be poured to and from the cavity 108.

As also shown in FIG. 1, the glass beverage container 100 further comprises a glass handle 114 that is attached to an exterior surface 115 of the side wall 106. In one embodiment, a first end 116 of the handle 114 is attached to an upper portion 120 of the exterior surface 115 of the side wall 106 and a second end 118 is attached to a lower portion 122 of the exterior surface 115 of the side wall 106. Preferably, the glass handle 114 is attached to the exterior surface 115 of the glass side wall 106 in a manner such that a person can pick up the beverage container 100 by grasping the handle 114.

As FIG. 1 further shows, a thermally insulating material 124 is positioned adjacent an outer surface 123 of the glass handle 114 and preferably extends across substantially the entire outer surface 123 of the handle 114. The insulating material 124 can be fixedly attached or detachably attached to the handle 114. Preferably, the thermally insulating material 124 is tightly wrapped around the glass handle 114 and is configured to fit the general contour of the handle 114. In one preferred embodiment, the thermally insulating material 124 comprises a material having a non-skid surface, such as a mesh-like reinforced rubber, rubberized latex, and/or Neoprene. Preferably, the thermally insulating material 124 has a thermal conductivity that is less than that of glass. However, it can be appreciated that the thermally insulating material can comprise a wide variety of material that provide thermal insulation.

In one preferred embodiment, the thermally insulating material 124 comprises a first layer 125 and a second layer 127. The first layer 125 is positioned adjacent an outer surface 123 of the glass handle 114 and wrapped around substantially the entire outer surface 123 of the handle 114. Preferably, the first layer 125 comprises a rubberized latex material and is bonded to the outer surface 123 of the glass handle 114 via a bonding agent. The W bonding agent can comprise a high strength adhesive containing components such as cyanoacrylate. In one embodiment, a gel form of super glue made by Loctite Corporation of Rocky Hill, Conn. sold under the name of QUICKTITE® can be used to bond the first layer of rubberized latex to the glass handle. Preferably, the adhesive is applied to substantially the entire exterior surface of the glass handle 114 to ensure that the rubberized latex forms a strong bond with the glass surface. Alternatively, the adhesive can be applied to a number of pre-determined locations on the exterior surface 123 of the glass handle 114 before bonding the first layer 125 to the glass surface. After formation of the first layer 125, the second layer 127 can be bonded to the exterior surface of the first layer 125, also by way of a suitable adhesive such as QUICKTITE®. Preferably, the second layer 127 comprises Neoprene and is wrapped around substantially the entire surface of the first layer 125. In one embodiment, the rubberized latex is approximately 0.1" thick and the Neoprene is also approximately 0.1" thick.

Advantageously, the rubberized latex material has a relatively high coefficient of friction and when it is wrapped around the glass handle in combination with Neoprene, a compressible and deformable material, it forms an insulating layer that is unlikely to slip and provides the user with a solid grip. However, it can be appreciated that the thickness, type and number of layers of thermally insulating material can vary without departing from the scope of the invention. For example, the thermally insulating material 124 can comprises a single layer of Neoprene or rubberized latex, or multiple layers of the same or different material. Moreover, in some embodiments, the insulating material 124 can be applied to the handle using an automated molding process.

Advantageously, the thermally insulating material 124 reduces the heat transfer between the glass handle and the hand of the person holding the handle. As such, the person can enjoy a cold or hot beverage while experiencing less of the discomfort of having to contact a cold or hot glass surface. Furthermore, the insulating material 124 of the preferred embodiments is selected to withstand the cold temperatures inside a freezer as well as the extreme hot temperatures in a dishwasher. Thus, the beverage container 100 can be chilled in the freezer prior to serving the beverage and then washed in high temperature wash cycles, all without substantially damaging the insulating material 124 or weakening the bond between the insulating material 124 and the outer surface of the glass handle. It can be appreciated that the beverage container 100 shown in FIG. 1 can be a conventional beer mug, soda glass, pitcher, or any other beverage container.

Figure 2:
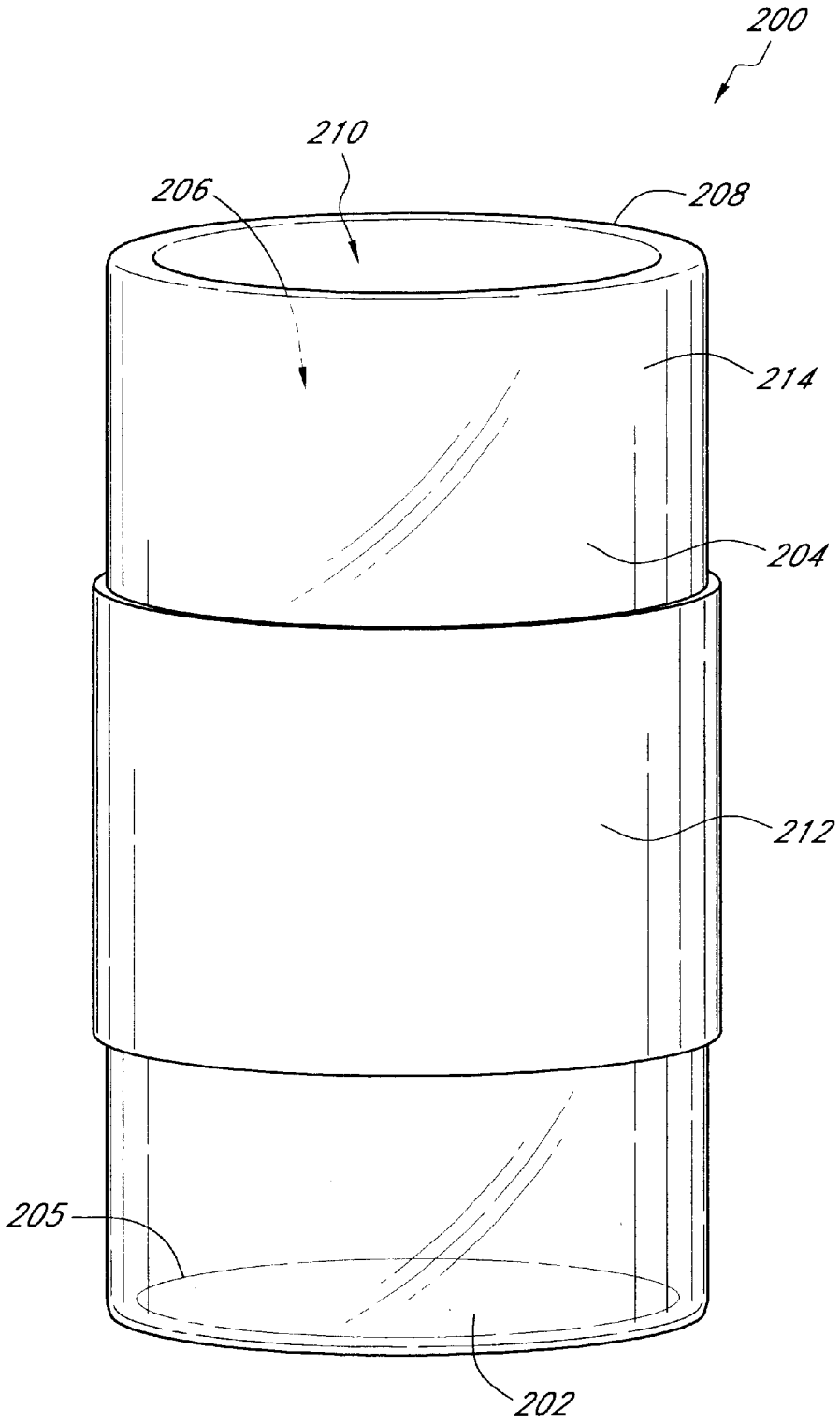
FIG. 2 illustrates a glass beverage container of another preferred embodiment.

FIG. 2 illustrates a glass beverage container 200 of another preferred embodiment. The glass beverage container 200 can be a beer glass, soda glass, a juice bottle, or a variety of other types of drinking vessels and/or liquid containers. As shown in FIG. 2, the glass beverage container 200 comprises a base 202 and a glass side wall 204 that extends from an outer perimeter 205 of the base 202 in a manner such that the base 202 and side wall 204 form a cavity 206 which liquid can be contained therein. Furthermore, an upper edge 208 of the side wall 204 define an upper opening 210 that is sufficiently large so as to permit liquid to be poured to and from the cavity 206. As shown in FIG. 2, the glass beverage container 200 further comprises a thermally insulating material 212 that is fixedly attached to an exterior surface 214 of the side wall 204. Preferably, the thermally insulating material 212 is attached to an area of the side wall 204 where a person typically holds the beverage container. In the example as shown in FIG. 2, the thermally insulating material 212 is positioned substantially half way between the base 202 and the upper opening 210 of the glass container 200, in an area where a person's hands are likely to contact when holding the glass. Preferably, the insulating material 212 extends across the circumference of the glass side wall so as to provide a protective strip of insulating material around the body of the container 200. In one embodiment, the thermally insulating material is fixedly attached to at least 30% of the exterior surface of the glass sidewall. In another embodiment, the thermally insulating material 212 comprises a rubberized latex material and/or a Neoprene material fixedly bonded to the exterior surface 214 of the side wall 204 of the beverage container 200 via a suitable adhesive such as a gel form of super glue made by Loctite Corporation of Rocky Hill, Conn. and sold under the name of QUICKTITE®. The thermally insulating material 212 reduces the amount of heat transferred between the glass side wall 214 and the hand of the person holding the glass container 200 so as to protect the person's hand from the coldness of the glass. Furthermore, the particular bonding agent selected preferably bonds the thermally insulating material 212 to the glass in a manner such that the material is substantially unaffected by repeated exposures to being chilled in a freezer or washed in high temperature water.

Advantageously, the glass beverage container incorporates a thermally insulating material that is attached to the exterior surface of the container in a manner so as to substantially protect a person's hands from the coldness or heat of the glass while holding the glass, which makes drinking from the container more enjoyable. Furthermore, unlike glass surfaces that can become slippery as a result of condensation, the non-skid surface of the thermally insulating material allows the person to obtain a solid and stable hold of the glass even if the glass container is filled with a cold drink. Moreover, in some embodiments, the thermally insulating material can also provide a surface for displaying designs, trademarks or logos. Advantageously, advertising material such as logos of the drinking establishment or restaurant can be printed on the exterior surface of the insulating material, which is an additional benefit provided by the glass beverage container of the preferred embodiments.

Although the foregoing description of the preferred embodiment of the present invention has shown, described and pointed out the fundamental novel features of the invention, it will be understood that various omissions, substitutions, and changes in the form of the detail of the method as illustrated as well as the uses thereof, may be made by those skilled in the art, without departing from the spirit of the invention. Consequently, the scope of the present invention should not be limited to the foregoing discussions, but should be defined by the appended claims.

What is claimed is:

1. A glass beverage container, comprising:

a base member;

a glass side wall extending from the outer perimeter of the base member in a manner such that a cavity is formed by the side wall and the base member;

a glass handle attached to an exterior surface of the glass side wall in a manner so as to permit a person to hold the handle by hand and lift the beverage container;

a one piece thermally insulating material positioned adjacent an exterior surface of the handle and fixedly attached to the handle so as to surround the handle, wherein the insulating material reduces the amount of heat transfer between the glass handle and the hand of the person holding the handle and wherein the insulating material is selected to conform to the shape of the handle so as to not substantially increase the cross-sectional width of the handle, wherein the insulating material has a first non-slip layer that is bonded to the exterior surface of the handle so as to surround and cover the handle and a second layer that is compressible so that a person holding the handle can compress sections of an outer surface of the insulating material so as to create a slightly indented gripping surface wherein the second layer is bonded to the first layer so as to surround and cover the first non-slip layer.

2. The glass beverage container of claim 1, wherein the thermally insulating material extends across substantially the entire exterior surface of the glass handle.

3. The glass beverage container of claim 1, wherein the thermally insulating material has a substantially non-skid surface.

4. The glass beverage container of claim 1, wherein the thermally insulating material has a thermal conductivity that is lower than the thermal conductivity of glass.

5. The glass beverage container of claim 3, wherein the thermally insulating material comprises at least one layer of a rubberized latex material.

6. The glass beverage container of claim 3, wherein the thermally insulating material comprises at least one layer of Neoprene.

7. The glass beverage container of claim 1 wherein the thermally insulating material comprises a first layer and a second layer, wherein the first layer is positioned adjacent to the outer surface of the glass handle, wherein the second layer is positioned adjacent an outer surface of the first layer.

8. The glass beverage container of claim 7, wherein the first layer comprises a rubberized latex and the second layer comprises Neoprene.

9. The glass beverage container of claim 1, wherein the thermally insulating material is fixedly bonded to the exterior surface of the glass handle by an adhesive comprising cyanoacrylate.

10. The glass beverage container of claim 1, wherein the glass beverage container is a beer mug.

11. The glass beverage container of claim 1, wherein the glass beverage container is a pitcher.

12. The glass beverage container of claim 1, wherein decorative designs are placed on an exterior surface of thermally insulating material.

* * * * *